US005826814A

United States Patent [19]

Gianfranco

[11] Patent Number: 5,826,814

[45] Date of Patent: Oct. 27, 1998

[54] SAFETY DEVICE FOR THE MANOEUVRING AND AUXILIARY WINCHING OF SELF-PROPELLED VEHICLES USED ON STEEP SLOPES

[75] Inventor: De Vettor Gianfranco, Busche, Italy

[73] Assignee: MDP Meccanica del Piave Spa, Longarone, Italy

[21] Appl. No.: 706,842

[22] Filed: Sep. 3, 1996

[30] Foreign Application Priority Data

Jul. 9, 1995 [IT] Italy ..... TV950047 U

[51] Int. Cl.[6] ..... B65H 75/40

[52] U.S. Cl. ..... 242/403; 242/557; 254/334

[58] Field of Search ..... 242/403, 158.3, 242/158.4, 534.2, 548.1, 557; 414/569; 254/334

[56] References Cited

U.S. PATENT DOCUMENTS

| | | | |
|---|---|---|---|
| 3,692,119 | 9/1972 | Tucker . | |
| 4,066,093 | 1/1978 | Egerstrom | 242/403 |
| 4,854,547 | 8/1989 | Oliphant | 254/271 |

FOREIGN PATENT DOCUMENTS

| | | |
|---|---|---|
| 305344 | 5/1973 | Austria . |
| 0719726A1 | 7/1996 | European Pat. Off. . |
| 1110217 | 2/1956 | France . |
| 1198208 | 12/1959 | France . |
| 1233602 | 10/1960 | France . |
| 2061059 | 6/1972 | Germany . |

*Primary Examiner*—John P. Darling
*Attorney, Agent, or Firm*—McAulay Fisher Nissen Goldberg & Kiel, LLP

[57] ABSTRACT

In a safety device for the manoeuvering and auxiliary winching of self-propelled vehicles used on steep slopes, of the type comprising a manoeuvering arm (20) along which travels a winching cable (28) an end of which is fixed to the top of the slope to be travelled up, a winding drum (32) is provided around which is coiled up said cable, said winding drum (32) being disposed on the manoeuvering arm (20) particularly on a portion thereof **(20*a*) essentially perpendicular to the plane in which said vehicle (10)** lies.

4 Claims, 3 Drawing Sheets

SAFETY DEVICE FOR THE MANOEUVRING AND AUXILIARY WINCHING OF SELF-PROPELLED VEHICLES USED ON STEEP SLOPES

The present invention relates to a safety device for the manoeuvering and auxiliary winching of self-propelled vehicles used on steep slopes. More precisely the device according to the present invention is of the type of which has been formed the object of the utility model application No. TV95U 000027 filed on May 15, 1995 in the name of same applicant, to specification, claims and drawings figures of which specific reference will be made.

Only for reference and comprehension convenience of the invention, in the introductory portion of the present specification, it will be proposed against and described in a synthetic way the fundamental features of the device forming the object of said application.

Also in this occasion, as already precised in the previous above application, specific reference will be made to use of the device for vehicles employed on snow covered terrains commonly referred to as "snow cats" or piste beaters. It is understood however that the scope of the invention extends also to use of the device on other types of vehicles.

Snow cats are widely used in order to flatten the snow and they are usually provided with crawler tracks driven by a suitable motor.

The action of the motor alone may not be evidently sufficient to cope with steep slopes so that said vehicles are provided with a suitable safety device, of the type of that object of the above previous patent application and of the present, thanks to which the vehicle is maintained stable particularly when it faces steep slopes avoiding of undergoing heavy damages or quite, to risk the life of the persons operating the vehicle.

The safety device in question essentially comprises a manoeuvering arm associated with the vehicle in freely rotatable manner about an axis perpendicular to the plane in which said vehicle lies. A winching cable is made to travel along the manoeuvering arm one end of which is fixed to the top of the slope to be travelled up, while the other is coiled up around a winding drum operated by a motor.

Since the manoeuvering arm is freely rotatable with respect to the vehicle, it disposes always on the same direction of the winching cable independently from the position of the vehicle.

Consequently the pulling force of the cable always passes along the axis of rotation of the manoeuvering arm thereby preventing the generation of torque moments on the arm which could make the vehicle unstable.

The device object of the previous above mentioned patent application comprises further safety devices, described and shown in said application, which now are not mentioned since they are not related with the object of the present invention.

The above mentioned device is revealed suitable to perform in a reliable and safe manner the task entrusted to it, but however has various drawbacks which render inconvenient the use thereof.

In fact the device in question, i.e. said manoeuvering arm and the winding drum of the winching cable, are all disposed on the frame or bodywork of the vehicle and more precisely said winding drum is directly supported by said frame and consequently it turns around a fixed axis when the winching cable unwinds or winds on said drum. Consequently the advancing direction of the cable is always the same and is essentially constituted by the segment thereof which joins the point in which it comes into contact with the winding drum and the inlet end in the manoeuvering arm.

The above situation, practically the stationary advancing direction of the winching cable, causes drawbacks since it is in contrast with the rotation or the rotations to which the manoeuvering arm is subjected. Said rotation or said rotations in fact involve a consequent rotation of the segment of the cable which is situated along the rotation axis of said arm, i.e. inside of the vertical portion thereof.

Said rotation caused in the cable by the arm is practically be transformed in a twisting thereof, said twisting being extensible also for a non negligible length thereof.

It is also noticed that, in case the manoeuvring arm achieves more than one turn of rotation, the torsion intensity is subjected to an increase which may become inconsistent with the integrity of the cable.

The above drawbacks are then emphasized by the fact that the cable is subjected to the tension solicitation when it is operative, i.e. subjected to a traction action the value of which is evidently not negligible. It has been devised and it forms the object of the present invention, a safety device of the type above indicated which allows to overcome all the above inconveniences.

It is therefore one of the principal aims of the present invention to provide a safety device in which the particular disposition of the winding drum of the winching cable is that the rotations of the manoeuvering arm do not cause a torsion or similar solicitation of the cable. A further not negligible arm of the present invention is to provide a safety device thanks to which, during the operation thereof, the cable is not subjected to any solicitation also in the case the manoeuvering arms should achieve more than one turn.

The safety device for the manoeuvering and auxiliary winching of self-propelled vehicles according to the present invention is therefore of the type comprising a manoeuvering arm associated to said vehicle and freely rotatably around an axis perpendicular to the plane in which said vehicle lies, a winding drum operated by drive means for the winding and unwinding from itself of a winching cable running along said arm, said safety device being characterized in that said winding drum is disposed on said manoeuvering arm. The winding drum therefore, besides to rotate for the winding or the unwinding of the winching cable, is integral with the manoeuvering arm in the rotations thereof.

The characteristics and the advantages of the safety device according to the present invention will be evident from the following detailed description of a non-limiting embodiment thereof, made with reference to the annexed drawings of which:

Figure 1:
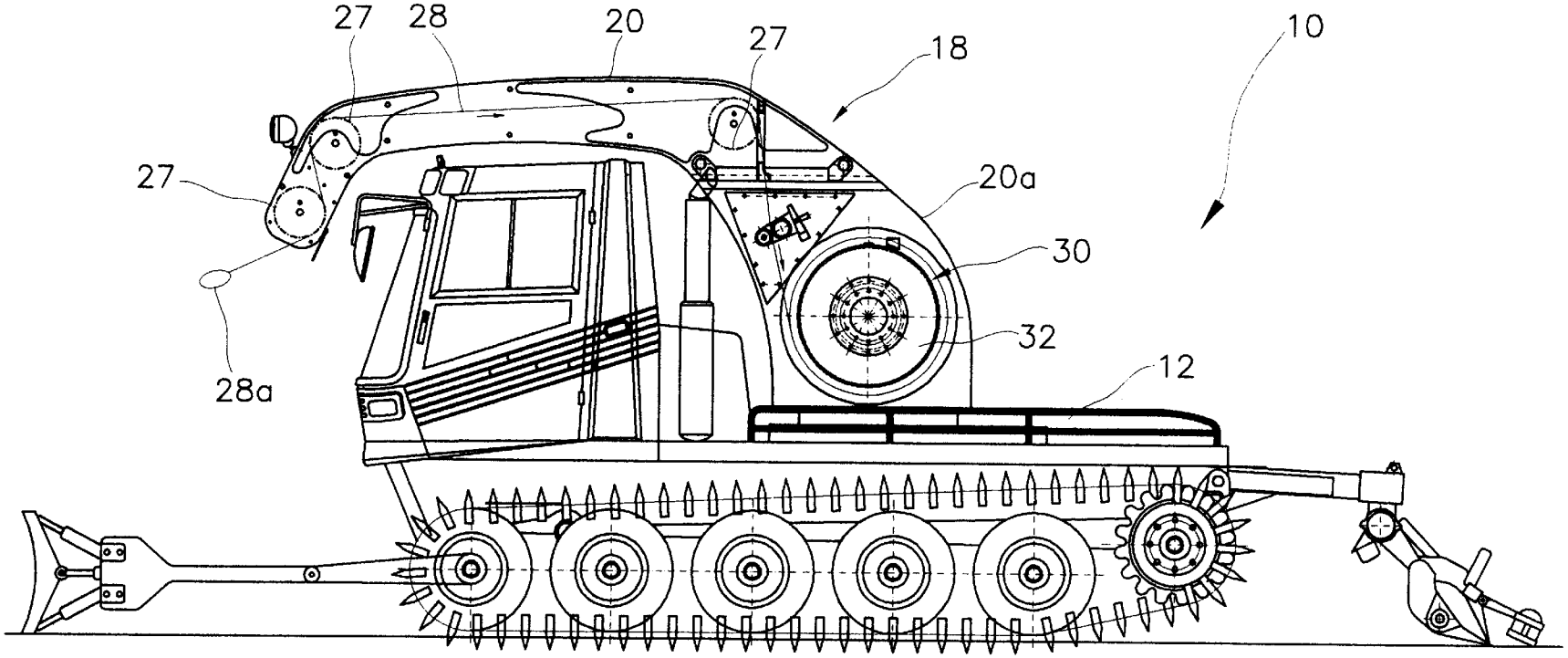
FIG. 1 is a schematic lateral view, partly in section, of a piste beater comprising the safety device according to the present invention.

With reference at first to FIG. 1, with 10 is indicated in its whole a self-propelled vehicle of the type of those employed an snow covered slopes.

A safety device for the manoeuvering and auxiliary winching indicated with 18 in its whole is provided on the frame 12 of the vehicle 10.

Figure 2:
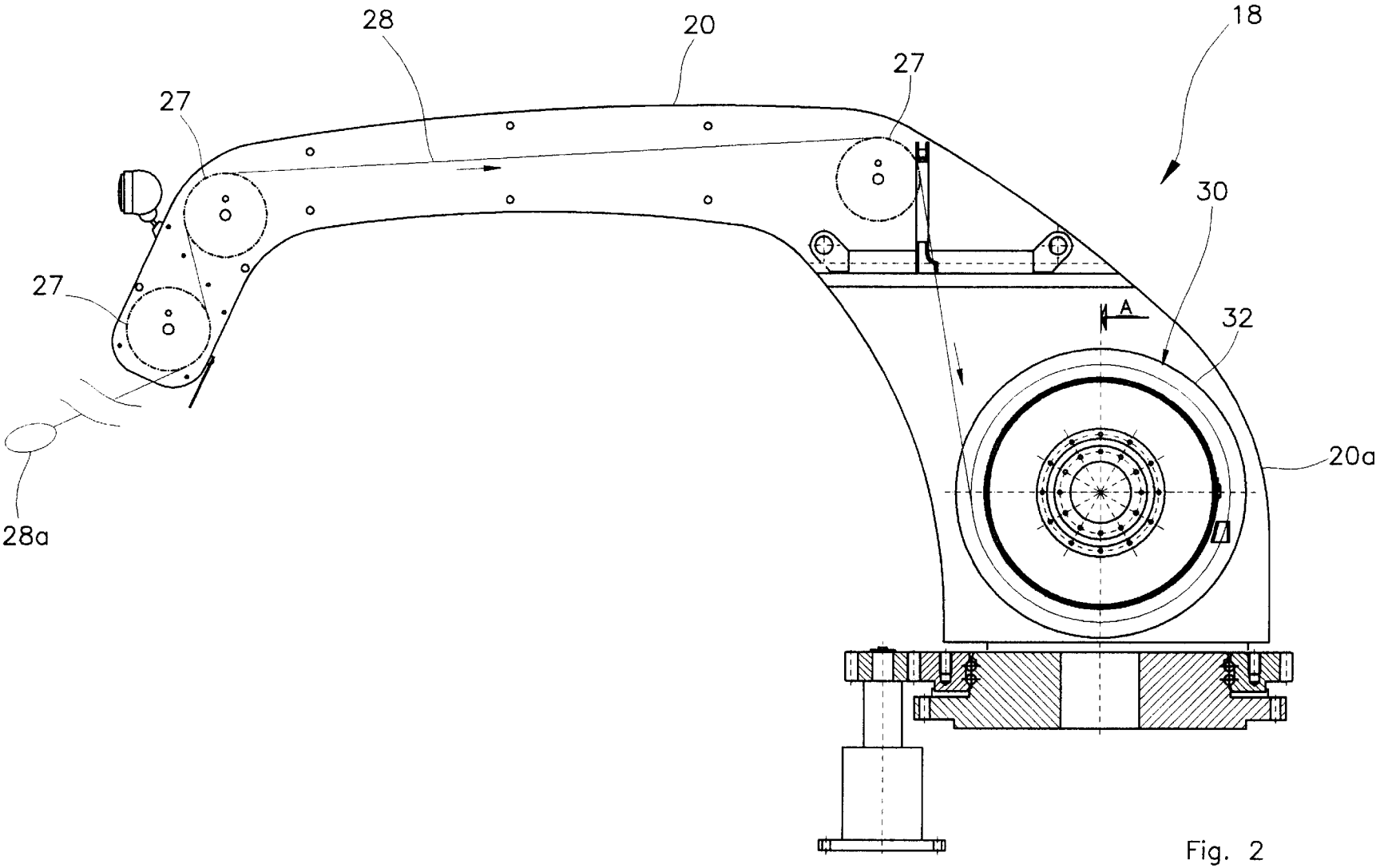
FIG. 2 is a schematic lateral view on a larger scale and in longitudinal section of the safety device according to the present invention.

The device 18, which may be seen more clearly in FIG. 2, comprises a manoeuvering arm 20 horizontally extending and has an essentially vertical portion 20*a* around the longitudinal axis of which the arm 20 is freely rotatable with respect to the frame 12 of the vehicle 10.

The rotational connection of the arm 20 with respect to the frame 12 may for instance, be carried out as described and shown in the above previous patent application.

Figure 3:
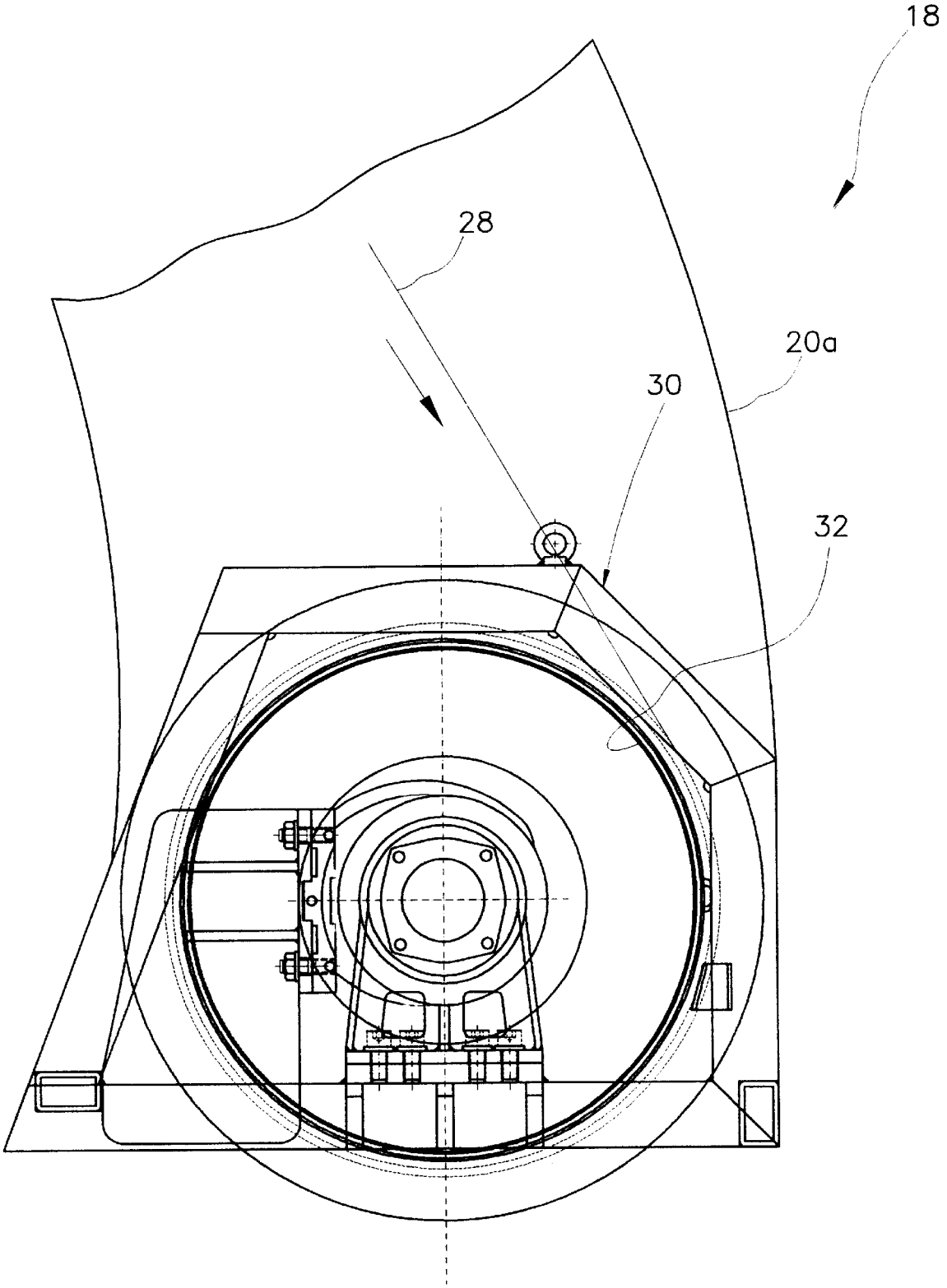
FIG. 3 is a schematic view in further enlarged scale with respect to FIG. 2 showing, in longitudinal section, the position of the winding drum inside the manoeuvering arm.

Inside the manoeuvering arm 20 is introduced in running manner a winching cable 28 one end 28*a* of which is fixed to the top of the slope to be travelled up, while at the other end, said cable 28 is wound on a winding drum 30, which may be seen more clearly in the FIGS. 2 and 3. For the running of the cable 28, inside the manoeuvering arm 20 a series of transmission and driving pulleys 27 is provided as described and shown more in detail in the previous patent application.

As the vehicle travels on the snow-covered ground to be worked, the cable 28 is gradually reintroduced into the manoeuvering arm 20 in order to be wound on the drum 30 which is operated by a suitable hydraulic motor not shown in the figures.

To the winding drum 30 are associated all the driving and control means shown and described in detail in the previous patent application and not mentioned again in the present description since they are not part of the innovative concept of the present invention.

The winding drum 30 which, according to the previous patent application, was rotatably supported by the frame 12 of the vehicle 10, according to the fundamental feature of the present invention, is now disposed inside the manoeuvering arm 20 and supported therefrom.

As it can be seen from the enclosed figures the winding drum 30 and more precisely the winding roller 32 on which the cable 28 is winding is disposed on the vertical portion 20*a* of the arm 20 and is supported by the same in a rotatably manner with respect to an axis essentially parallel to the plane in which the vehicle lies. The support means of the roller 32 may be of whatever type, for example those described more in detail in the previous patent application.

From that has been described it is easy to understand that the roller 32 for the winding of the cable 28 , being directly supported by the manoeuvering arm 20, particularly by the portion 20*a* thereof, is integral to said arm 20 in the rotation thereof during the operation of the device. The segment of the cable 28 comprised between said roller 32 and the first transmission pulley 27 is not accordingly subjected to a twisting solicitation since there is not relative movement between the roller 32 and the manoeuvering arm 20, particularly the first transmission pulley 27 since both turn together with the arm 20. The drawbacks of the device of the traditional device object of the above mentioned previous patent application are therefore eliminated and accordingly the cable 28 is only subjected to the solicitation requested for its operation, i.e. to a traction which allows to it compensate a possible insufficient action of the driving motor of the vehicle.

The advantages of the device according to the present invention are evident since, besides the more relevant advantage of having eliminated the torsion of the winching cable 28, have been also eliminated solicitations and undesired obstacles of the manoeuvering arm 20 during its operation particularly deriving from said torsion.

From what above described is therefore evident that the winching action made by the cable 28 is integrally exploited for said action of manoeuvering and winching of said vehicle which therefore will be more stable with respect to the previous version in which the winding roller 32 of the cable 28 were supported by its frame 12.

It is finally clear that changes and/or modifications structurally and conceptually equivalent may be made to the device according to the present invention without departing from the scope thereof.

What is claimed is:

1. Safety device for the manoeuvering and auxiliary winching of self-propelled vehicles used on steep slopes, of the type comprising a manoeuvering arm (20) associated with a vehicle freely rotatable around a rotation axis essentially perpendicular to a plane in which said vehicle (10) lies, a winding roller (32) operated by drive means for winding a winching cable (28) one end of which is fixed to the top of a slope to be travelled up, wherein said winding roller (32) of the winching cable (28) is disposed on the manoeuvering arm (20).

2. The device according to claim 1, wherein said winding roller (32) is housed within the manoeuvering arm (20) in a portion (20*a*) thereof essentially perpendicular to the plane in which said vehicle (10) lies upstream of a series of transmission pulleys (27).

3. The device according to claim 2, wherein said winding roller (32) is rotatable around an axis essentially perpendicular to said rotation axis of the manoeuvering arm (20) for winding or unwinding of the winching cable (28).

4. The device according to claim 1, wherein said winding roller (32) is rotatable around an axis essentially perpendicular to said rotation axis of the manoeuvering arm (20) for winding or unwinding of the winching cable (28).

* * * * *